United States Patent [19]

Paulose et al.

[11] 4,402,788

[45] Sep. 6, 1983

[54] PROCESS FOR BLEACHING WOOD PULP WITH HYDROGEN PEROXIDE

[75] Inventors: George Paulose, Federal Way, Wash.; Raman Ambady, Fairfield, Ohio; James R. Kidd, Decatur, Ala.; Hector Ferguson, Hamilton, Ohio

[73] Assignee: Champion International Corporation, Stamford, Conn.

[21] Appl. No.: 372,233

[22] Filed: Apr. 26, 1982

[51] Int. Cl.[3] ..... D21C 9/16

[52] U.S. Cl. ..... 162/78; 162/89

[58] Field of Search ..... 162/78, 89

[56] References Cited

U.S. PATENT DOCUMENTS

| | | | |
|---|---|---|---|
| 1,998,389 | 4/1935 | Scheller | 162/78 |
| 2,668,095 | 2/1954 | Fennell | 162/78 |
| 2,779,656 | 1/1957 | Fennell | 162/78 |
| 2,920,011 | 1/1960 | Eilers, Jr. | 162/78 |

*Primary Examiner*—William F. Smith

*Attorney, Agent, or Firm*—Evelyn M. Sommer

[57] ABSTRACT

In the bleaching of wood pulp using the conventional CEH sequence with subsequent oxidation stages, the third stage (H) is replaced by peroxide oxidation (P) to a brightness level of 35–50 GE. Final brightness levels of 70–88 GE are attained using no greater amounts of chemicals in the subsequent stages than are required in the conventional CEHDH process. The temperature in the P stage is between 120° and 170° F.

4 Claims, No Drawings

PROCESS FOR BLEACHING WOOD PULP WITH HYDROGEN PEROXIDE

BACKGROUND OF THE INVENTION

This invention relates to an improved process for bleaching wood pulps, such as kraft pulp. More particularly, it relates to a multi-stage process in which hydrogen peroxide is used in the third stage in lesser amount than has heretofore been believed to be necessary. Appropriate temperature adjustments in the other stages, coupled with the use of less chemical in the third stage, results in a more economical process with no sacrifice in final brightness level.

Although the main objective is bleaching is to make pulp whiter and brighter to the eye, many other objectives must be kept in mind. Usually, but not always, it is desired to make the pulp white without damaging the strength characteristics of the paper to be made from the pulp. In some cases, it is desired to purify the pulp as well as to whiten it during the bleaching process by dissolving the lignin, resin, metal ions, and noncellulose carbohydrate components. For some types of dissolving pulps, it is required to bleach and simultaneously to lower the viscosity of the pulp to a predetermined level. For most purposes, it is desired to make the pulp not only white and brighter, but also to make it stable in order that it will not become yellow or lose brightness or strength on aging.

Beating pulp lowers its brightness, decreases its absorbency, and changes it in other ways, and therefore it is often required to bleach with minimum mechanical action on the pulp. Since carbonyl groups in cellulose and hemicellulose cause color reversion on aging, sensitivity to alkali and other phenomena, it is generally desired to bleach without introducing carbonyl groups into the pulp and, if possible, to diminish the content of such groups during the bleaching process.

Another very important objective, which is inseparable from all the others, is to keep the cost of bleaching to a minimum. This means bleaching with the least possible loss in pulp weight. It means selecting chemicals which permit bleaching to the required specifications with minimum cost when the amount of substance is multiplied by its unit price. Furthermore, if two bleaching processes give the same end product with the same chemical cost, the one requiring the least capital investment, the lowest maintenance cost, and minimum labor, power, and heat for operation and control would normally be chosen.

The main light-absorbing substances in wood pulp are derived from the lignin and resin components of the original wood. Therefore, to make pulp whiter, these substances must either be chemically changed in the solid state to diminish their light-absorbing characteristics, or be oxidized, reduced, or hydrolyzed to make them soluble in aqueous solutions in order to remove them from the pulp.

Bleaching with removal of lignin may be regarded in one sense as a continuation of the chemical pulping process. In order to make the fibers easily separable, the main object of chemical pulping is the removal of the lignin from the wood with minimum solution of the carbohydrate constituents, which is also the object in bleaching wood pulps. The initial removal of the bulk of the lignin by cooking is carried out with nonoxidizing substances such as alkalis, sulfides, or sulfites because they are cheap, may be used as high temperatures to speed up diffusion into the wood, and often can be recovered for reuse. However, these pulping processes cannot be carried to complete removal of the lignin without seriously degrading the carbohydrate fraction and dissolving a large part of it. Such processes leave the unbleached pulp at brightness levels varying from 20 to 65 GE.

Lignin has high reducing capacity and a suitable oxidizing agent for bleaching must be cheap, and be able to oxidize lignin readily with minimum attack on the carbohydrates. So far, no single chemical substance has been found which is cheap enough to be used commercially, and which has sufficient selectively for oxidizing lignin and dissolving it without damaging the cellulose, to bleach pulp in a single stage. Among known substances, chlorine dioxide comes closest to meeting these requirements. Although it can be used along the bleach pulp in a single stage, it is cheaper and better to use chlorine dioxide as part of a multistage bleaching system.

Chlorine is the cheapest available oxidizing agent (other than air), and it reacts very rapidly with lignin at low temperature, causing only small damage to the carbohydrate fraction of pulp. However, it does not make pulp white, since it merely chlorinates and oxidizes the lignin without dissolving much of it. The pulp is frequently darker after treatment with chlorine, and is usually a golden-orange color. Chlorine is usually used to satisfy the major part of the oxygen demand of lignin because it is cheap and saves the more expensive bleaching agent required for final whitening, and because the products of its reaction with lignin are readily soluble in dilute sodium hydroxide solution.

The second treatment in most bleaching processes is therefore an extraction with dilute aqueous sodium hydroxide solution at elevated temperatures to dissolve the chlorinated and oxidized lignin to prevent it from consuming bleaching agent in the subsequent treatment of the pulp. The caustic (NaOH) extraction stage also dissolves some resin components and some hemicellulose, the amount removed depending on the ratio of sodium hydroxide to pulp, and on the consistency, temperature, and time of treatment.

Further oxidation of the pulp for removal of the remaining lignin and whitening may be carried out with several reagents. Calcium hypochlorite has been used for more than a century, because it is cheap and quite effective. Sodium hypochlorite is preferred in some mills, chiefly because it is much simpler to prepare from chlorine and caustic soda, although some claim is made that pulp cleanliness is improved. Furthermore, the use of sodium, rather than calcium hypochlorite reduces scaling problems and facilitates recyling of the filtrate. Chlorine dioxide has replaced hypochlorite to some extent. More recently, sodium or hydrogen peroxide has found use either as a replacement for hypochlorite or as an additional step in the proces.

Multistage bleaching is now used in virtually all commercial pulp bleaching operations. In mill bleaching practice, the following abbreviations are used for various individual stages in the operation:

C=chlorination
E=extraction with sodium hydroxide
H=oxidation with hypochlorite
D=oxidation with chlorine dioxide
p=oxidation with peroxide Further background and details regarding bleaching of wood pulp in general, and bleaching of kraft pulp, in particular, may be found in TAPPI Monograph No. 27 (1963, W. Howard Rapson, ed.) and in Rydholm, "Pulping Processes," ch. 12-17 (Interscience Publishers, 1965).

Unbleached kraft pulps have extremely low brightness levels (20-30 GE) and bleaching to a desirable brightness level of 80 GE or above has historically posed special problems. It was logical to expect that an increase in brightness of over 60 points would require large amounts of chemicals and, in order to preserve pulp strength, would also necessitate the use of a rather large number of individual stages. The most common sequences in kraft pulp bleaching processes are CEHEH, CEHDH, CEDED, and CHEDH. Of particular interest are those in which clorination and extraction with sodium hydroxide are the first two stages.

With the kraft pulp bleaching processes now known, it is possible to obtain up to 82 to 88 GE brightness levels, without sacrificing more than about 5 to 7% of the strength of the pulp. The realization of these results, however, requires careful control of the various stages. Within the first stage, the pulp is supplied with such elemental chlorine as it can absorb within the allotted time (30 to 60 minutes) at the temperature of the mill water, typically about 80°-100° F. (26°-38° C.). The amount of chlorine absorbed will vary between about 80 and 140 pounds per ton of pulp and is a function of the permanganate number (PN) of the pulp. The second stage, extraction with caustic soda, is operated at an elevated temperature, i.e., between about 135° and 165° F. and its function is to dissolve the chlorinated lignin and give the desired reduction in PN value. About 2 to about 3% of caustic soda is generally required for this purpose.

In the kraft pulp bleaching process, the third stage is regarded as quite critical, its traditional function being to bring the brightness level to within 10 to 20 points of its desired final value. In order to preserve the pulp strength, careful control of pH and temperature is necessary. Particularly, the temperature in the third stage, if it is oxidation by hypochlorite (H), should be no higher than about 110°-115° F. (43°-47° C.).

Hydrogen or alkaline peroxides have been used in the later stages of pulp bleaching for the purpose of brightness stability. Sequences for wood pulp bleaching such as CEHEHP, CEHDP, CEHPHP and others are known to be in commercial use. Furthermore, the use of peroxide in the third step of a bleaching process for sulfate pulp is described in an article by Christensen, "Bleaching Sulphate Pulp with Hydrogen Peroxide," *Pulp and Paper Magazine of Canada* 73, No. 2, 62-66 (1972), pertinent portions of which are incorporated herein by reference. The use of peroxide in the third stage of a kraft pulp bleaching process is suggested in the literature. However, because the third step of this process is expected to bring the GE brightness level up to within 10 to 20 points of the desired final brightness level—i.e., the brightness level in the third stage should be brought up to 60-70 GE—there is no economic incentive to use peroxide at this stage in the bleaching of wood pulp.

SUMMARY OF THE INVENTION

We have now discovered that peroxide oxidation can be used as the third stage of a wood pulp, partucularly kraft pulp, bleaching process and that, in said stage, the brightness level should reach only 35 to 50 GE. One or more subsequent stages in the process involve oxidation by chlorine dioxide and/or by hypochlorites and/or by peroxide to a brightness level of 80 to 88 GE. The amounts of oxidizing agent, used in these subsequent stages are no greater than would be necessary to achieve the same level of brightness where hypochlorite is employed in the third range to attain a brightness level of 60 to 70 GE.

DETAILED DISCLOSURE

In a normal wood pulp bleaching sequence, such as CEHDH, the brightness target in the third stage is about 60 to 70 GE, in order to achieve a final brightness of 80 to 90 GE. If there is more spread between the achieved brightness level in the third stage and the final desired brightness level, the amount of chlorine dioxide (D stage) will have to be increased in order to achieve the desired result. It would be expected that, if one were to use peroxide rather than hypochlorite in the third stage, one would similarly have to attain a brightness level of 60 to 70 GE. Under these circumstances, the relative costs of peroxide and hypochlorite would render the use of peroxide quite uneconomical.

We have now found, quite surprisingly, that by limiting the target brightness in the third stage to only 35 to 50 GE, one need to use only between about 0.3 and about 0.4 weight percent of peroxide in the third stage. Furthermore, the amount of chlorine dioxide required in the fourth stage and the amount of hypochlorite in the fifth stage required to attain the desired brightness level, is substantially identical regardless of whether the third stage is a hypochlorite oxidation to a brightness level of 60 to 70 or whether it is a peroxide oxidation according to this invention. There is thus considerable savings in cost, one which could not be achieved if it were necessary to attain a brightness level of 60 to 70 in a third stage peroxide oxidation.

In addition to the advantages flowing from the use of less chemical in the kraft pulp bleaching process, there are further economies realized because a third stage peroxide oxidation can be run at higher temperature than a third stage hypochlorite oxidation. In a typical CEHDH sequence, the temperature of the chlorination (C) is about 80° to 100° F. (26°-38° C.), although technology exists for running this stage as high as 165° F. (74° C.). The caustic extraction stage is most effectively run at a minimum of about 130° F. (54° C.) and a maximum up to about 180° F. (82° C.). The third stage, hypochloride oxidation (H) must be run at temperatures no higher than about 115° F. (46° C.), in order to avoid cellulose degradation. The fourth step, oxidation with chlorine dioxide (D) is most advantageously run at temperatures of about 165° F. (74° C.), and the final treatment with hypochlorite (H) is run again at no higher than 115° F. (46° C.). It can readily be seen that there is the necessity for cooling just prior to the third step (H) and heating immediately thereafter. By the practice of this invention, the necessity of expending energy in heating and cooling prior to and after the third stage is avoided. The approximate temperature ranges for the CEPDH sequence according to the invention are shown in the following Table I:

TABLE I

| Stage | Broad Range | Preferred Range |
|---|---|---|
| C | 50°-165° F. (10°-74° C.) Depending on mill conditions, and | |

TABLE I-continued

| Stage | Broad Range | Preferred Range |
|---|---|---|
| | equipment | |
| E | 120°-180° F. (49°-82° C.) | 130°-140° F. (54°-60° C.) |
| P | 120°-190° F. (29°-88° C.) | 150°-165° F. (54°-74° C.) |
| D | 150°-180° F. (65°-82° C.) | 160°-165° F. (71°-74° C.) |
| H | 100°-115° F. (38°-46° C.) | |

In a mill where facilities for hot chlorination exist, the C, E, P and D stages can all be run at about 165° F. (74° C.), or the C, E, and P stages run at 150° F. (65° C.) and the D stage at 165° F. (74° C.). The normal industry practice is to replace about 10% of $Cl_2$ in the first stage with $ClO_2$ in order to reduce pulp degradation during hot chlorination. This stage, where part of the $Cl_2$ is substituted with $ClO_2$, is designated $C_D$.

This invention will be better understood by reference to the following examples, which are included here for illustrative purposes only and are not to be construed as limitations.

EXAMPLES

In Examples 1 and 2, the same kraft pulp was employed. Mill production pine pulp after the extraction stage (CE) with permanganate number 6.1 was used in the further stages shown in Examples 1 and 2. In Example 1, the stages are HDH. In Example 2, the stages are PDH. The chemicals employed, reaction conditions and results obtained in Examples 1 and 2 are shown in the following Table II.

TABLE II

| | EXAMPLE 1 | | | EXAMPLE 2 | | |
|---|---|---|---|---|---|---|
| Bleaching Stage | H | D | H | P | D | H |
| CaCl - av. Cl % | 1.6 | | .05 | | | .20 |
| $H_2O_2$ - % | | | | .35 | | |
| NaOH - % | .6 | | .22 | .6 | .4 | .25 |
| $ClO_2$ | | .8 | | | .8 | |
| $Cl_2$ | | .107 | | | .107 | |
| Consistency % O.D. pulp | 8 | 8 | 8 | 8 | 8 | 8 |
| Bleaching Time - mins. | 60 | 180 | 60 | 60 | 180 | 60 |
| Bleaching Temp. °F. | 120 | 165 | 120 | 150 | 165 | 120 |
| pH, start | 10.8 | | 10.2 | 10.6 | | 10.1 |
| pH, final | 9.1 | 3.2 | 9.5 | 10.5 | 3.7 | 9.2 |
| Residual Chemicals, Titer (100 cc)(1) | .11 | 2.35 | 0 | 1.52 | 0.92 | 2.16 |
| Residual Chemicals(2) % | .004 | .036 | 0 | .03 | .014 | .088 |

TABLE II-continued

| | EXAMPLE 1 | | | EXAMPLE 2 | | |
|---|---|---|---|---|---|---|
| Bleaching Stage | H | D | H | P | D | H |
| Consumed Chemicals(3) | 99.7 | 95.4 | 100 | 91.5 | 98.2 | 64.7 |
| GE brightness, % | 62.8 | 83.9 | 84.1 | 43.2 | 80.8 | 84.7 |
| Viscosity, Cps | 15.6 | 15.9 | 15.7 | 17.3 | 17.6 | 17.0 |

(1)Residual chemical at the end of the bleaching stage expressed as ml. of 0.1N sodium thiosulfate per 100 ml. of the filtrate
(2)Total residual chemical at the end of the bleaching stage expressed as % based on pulp
(3)Consumed chemical expressed as %

The data show that with the use of peroxide the brightness target in the third stage can be considerably less than would be required if hypochlorite were used in this stage and still achieve final product GE brightness comparable to that obtained using hypochlorite in the third stage. Furthermore, it should be noted that this brightness level is achieved without the use of any substantial increase in chlorine dioxide and hypochlorite in the fourth and fifth stages than were used in the conventional CEHDN sequence.

The foregoing examples show the use of this invention in a kraft pulp CEPDH bleaching process. The invention should be equally applicable to other wood pulps such as sulfite pulp. Furthermore, the oxidation stages subsequent to the third stage (P) are not limited to chlorine dioxide followed by hypochlorite (DH). This invention is applicable to other sequences such as CEPD, CEPDP, etc.

We claim:

1. In a multi-stage process for bleaching wood pulp which comprises a first stage of chlorination, a second stage of extraction with sodium hydroxide, and subsequent stages of oxidation, to obtain a bleached wood pulp with a GE brightness level of 70 to 88, the improvement which comprises subjecting the pulp from the second stage to a third stage of oxidation with peroxide in an amount sufficient to attain a GE brightness level of 35 to 50, whereby the amounts of oxidizing agents required in the subsequent stages are substantially identical to the amount of oxidizing agents required when said third stage is oxidation with hypochlorite to a GE brightness level of 60 to 70.

2. The improvement according to claim 1 in which the temperature employed in the third stage is from about 120° and 190° F.

3. The improvement according to claims 1 or 2 in which the multi-stage process is a process for bleaching kraft pulp.

4. The improvement according to claim 3 in which the subsequent stages of oxidation consist of a fourth stage employing chlorine dioxide and a fifth stage employing hypochlorite.

* * * * *